US006003444A

United States Patent [19]

Perry, Jr.

[11] Patent Number: 6,003,444

[45] Date of Patent: Dec. 21, 1999

[54] DOLLY FOR STRAIGHT SIDE CONVEYOR PAN

[75] Inventor: Hubert A. Perry, Jr., Wellesley, Mass.

[73] Assignee: Adamation, Inc., Newton, Mass.

[21] Appl. No.: 09/056,728

[22] Filed: Apr. 7, 1998

[51] Int. Cl.[6] ..... B61B 12/00

[52] U.S. Cl. ..... 104/244; 105/157.1; 198/802; 134/126

[58] Field of Search ..... 104/242, 244, 104/245; 105/157.1; 134/25.1, 25.2, 25.3, 25.4, 61, 63, 70, 71, 72, 76, 77, 82, 124, 125, 126, 165; 198/494, 793, 802, 803.14, 837, 838; 238/10 R

[56] References Cited

U.S. PATENT DOCUMENTS

| | | | |
|---|---|---|---|
| 3,550,755 | 12/1970 | Noren | 198/494 |
| 3,698,407 | 10/1972 | Noren | 134/70 |
| 4,063,634 | 12/1977 | Perry | 198/802 |
| 4,274,886 | 6/1981 | Noren | 134/25.2 |
| 4,676,365 | 6/1987 | Noren | 198/803.14 |
| 5,775,227 | 7/1998 | Mullen | 104/244 |

FOREIGN PATENT DOCUMENTS

| | | | |
|---|---|---|---|
| 404195 | 1/1934 | United Kingdom | 104/244 |

*Primary Examiner*—Mark T. Le
*Attorney, Agent, or Firm*—Samuels, Gauthier & Stevens

[57] ABSTRACT

A dolly for use in a straight sided flat bottom conveyor pan. The dolly is comprised of a frame, a pair of inner wheels and a pair of outer wheels. The inner wheels travel on an inner track of a conveyor pan and the outer wheels travel on an outer track of the conveyor pan. The leading wheels are secured to the frame along an axis which is coincident with a radius R. The trailing wheels are secured to the frame along an axis which coincident with a radius $R^1$. The radii define an acute angle which will vary depending upon the actual dimensions of a curve through which the dolly will travel.

6 Claims, 1 Drawing Sheet

DOLLY FOR STRAIGHT SIDE CONVEYOR PAN

BACKGROUND OF THE INVENTION

1. Field of the Invention

The invention relates to a dolly used in commercial warewashing.

2. Description of Related Art

In commercial warewashing systems such as sold to hotels, resorts, universities and the like, there are typically several zones through which pass dishes, glasses, flatware, etc. to be cleaned. There are several methods in which these items are passed through the zones.

In one specific method, the dishes, glasses, flatware, etc. are placed in racks, usually 20"×20" racks, and the racks in turn are placed on dollies. The dollies are supported on a conveyor pan and typically travel a continuous path through the several zones. Sections of the path are curved. Travel of the dollies through the curved sections (turning) is demanding on the dolly wheels and the conveyor pan. The dolly wheels have a flat bottom surface and a convex edge. A single point on the wheel edge comes into contact with the side of the conveyor pan. The flat side of the wheel lies in a horizontal plane spaced apart from the surface of the conveyor pan that supports the dollies. The conveyor pan has walls which are s-shaped (not straight sided) to define tracks for the wheels. The shaped walls (tracks) accommodate the dolly wheels which are turning in a horizontal plane but must turn against an angled surface to prevent grinding and abrasion by the wheels of the conveyor pan when the dollies are turning curves. In this configuration, the rack rides above the wheels and the width of the rack is generally equal to the distance between the dolly wheels on opposed sides of the dolly.

On these systems with s-shaped sides, there are four welds on each currently manufactured conveyor pan to accommodate the dolly wheels, dolly track, trough, end plate and straight-away track trough. This large amount of welding and the subsequent grinding and polishing of these welds greatly adds to the manufacturing costs.

Conveyor pans which have straight sides and flat bottoms to support dollies carrying racks are known in the art. However, the width of the dolly is greater than the width of the rack which is supported by the dolly. To support the dolly the width of the conveyor pan must be greater than the width of the rack. Because of this disparity in width, there is wasted space and lack of economy. The entire system, conveyor pan, cabinets for rinse and wash zones must be wider than the rack carrying the wares to be treated in order to accommodate the width of the dolly.

Dollies for supporting 10" w×20" l racks have been known for over thirty years. These dollies travel on a conveyor pan having a flat bottom and straight sides. However, the opposed dolly wheels supporting the 10"×20" tray are spaced apart 16". In essence, four dolly wheels in a rectangular 16"×20" configuration support a 10" wide×20" long rack. The disparity in widths 10" versus 16" is to enable the 10"×20" rack to travel through the curved sections of the conveyor pan.

SUMMARY OF THE INVENTION

The present invention comprises a dolly that can travel on a straight-sided conveyor where the width of the rack is generally equal to the distance between the dolly wheels. The welds associated with prior art conveyor pans are not necessary.

In the present invention, there are two pairs of wheels. There are inner and outer leading wheels and inner and outer trailing wheels. The inner wheels travel on the inner track of the conveyer pan and the outer wheels travel on the outer track of the conveyor pan. The leading wheels are secured to a dolly frame along an axis which is coincident with a radius R. The trailing wheels are secured to the dolly frame along an axis which is coincident with a radius $R^1$. The radii define an acute angle which angle will vary depending upon the actual dimensions of the curve through which the dolly will travel. That is, the leading and trailing pairs of wheels are placed at different radii for conveyor pans with a sharp curve versus a machine with a gradual curve. This is determined by the swing angle as the dolly goes around the curves.

A connecting rod between dollies allows the wheels to relieve stress and strain on the dolly train system and because the dollies with the wheels do not have to be constrained within closely confined surfaces (S-tracks). More slop is allowed to exist in the system.

In a preferred embodiment, the invention comprises a dolly for use in a straight-sided conveyor pan which dolly comprises a frame having an outer leg and an inner leg. A pair of outer wheels characterized by a flat bottom surface and a convex edge are secured to the outer leg and spaced apart from one another a first distance. Another pair of identical inner wheels are secured to the inner leg and spaced apart from one another a second distance which second distance is less than the first distance.

DESCRIPTION OF THE PREFERRED EMBODIMENT(S)

Figure 1:
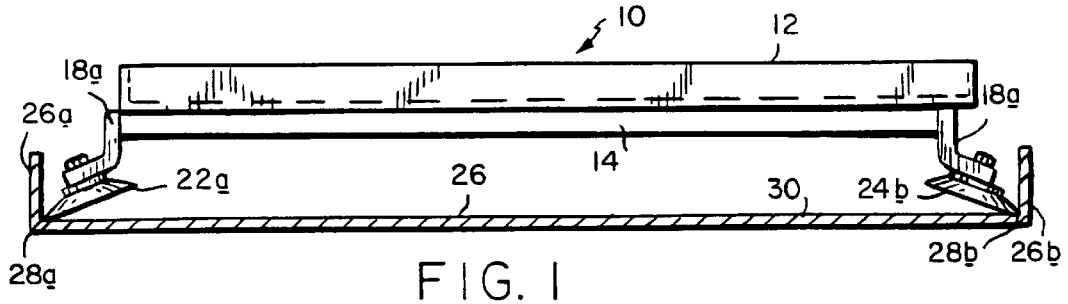
FIG. 1 is a front view of a dolly embodying the invention.
Figure 2:
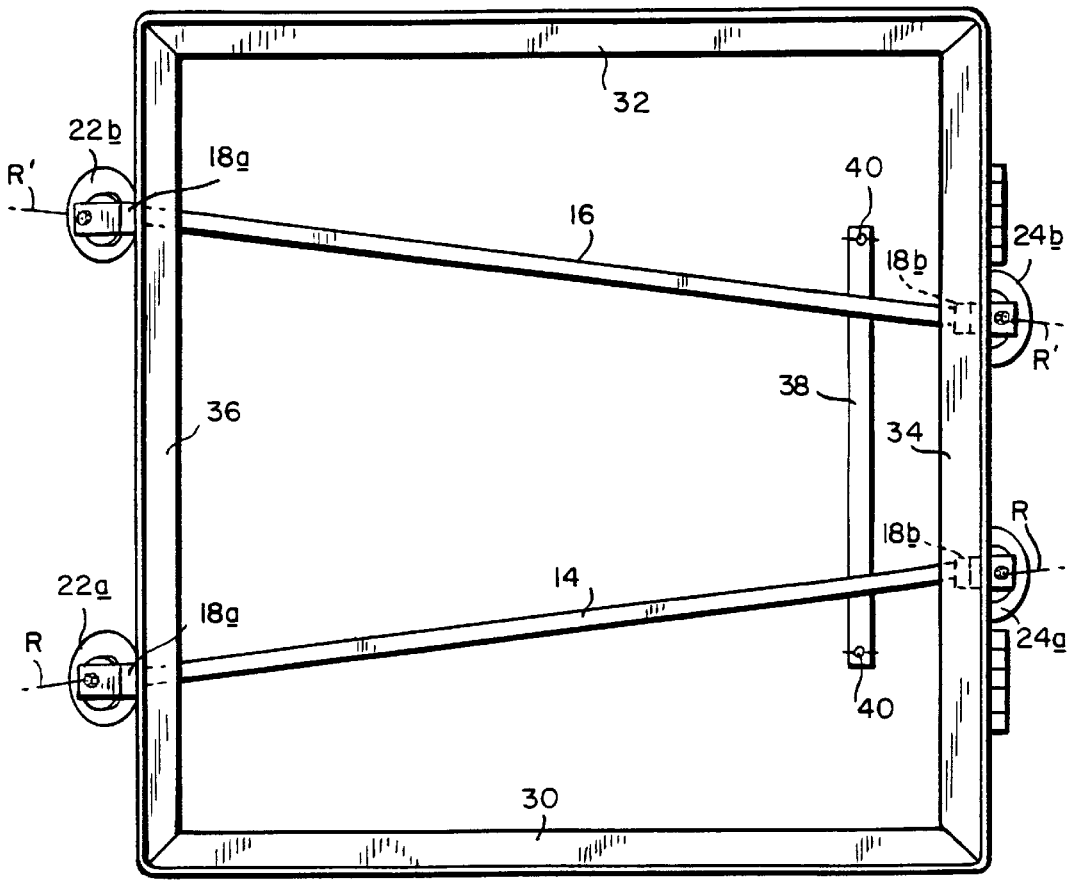
FIG. 2 is a plan view of FIG. 1.
Figure 3:
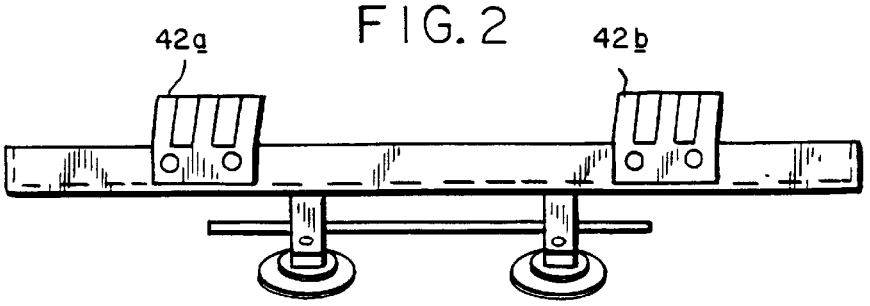
FIG. 3 is a right side view of FIG. 1.

Referring to FIGS. 1 and 2, a dolly 10 embodying the invention is shown and comprises a frame 12, support bars 14 and 16 secured thereto, such as by welding, both to the underside of the frame 12. Secured to the ends of the support bars 14 and 16 are angled arms 18*a* and 18*b*. Rotatably pinned to the angled arms 18*a* are inner wheels 22*a* and 22*b* and rotatably pinned to the arms 18*b* are outer inner wheels 24*a* and 24*b*. The bottom surfaces of the wheels as shown are flat and are angled with reference to horizontal, e.g. 20°. A conveyor pan 26 has straight-sided walls 26*a* and 26*b*.

The juncture of the wall 26*a* and the floor of the conveyor pan 26 define an outer track 28*a* and the juncture of the wall 26*b* the conveyor pan 26 define an inner track 28*b*.

The wheels 22*a* and 24*a* comprise leading wheels, with reference to the direction of travel of the dolly, and they lie along an axis which is coincident with the radius R. The wheels 22*b* and 24*b* comprise trailing wheels, and they lie along an axis which is coincident with the radius $R^1$. The radii diverge outwardly from one another or stated otherwise, form an acute angle with one another.

Referring to FIG. 2, the frame 10 comprises front and back L-shaped members 30 and 32 and an inner leg 34 and an outer leg 36. A stabilizing bar 38 is welded to the underside of the support bars. The stabilizing bar 38 is characterized by connector holes 40. Connecting rods with pins (not shown) are inserted in these holes 40 to connect one dolly to another. The inner leg 34 also has drive blocks 42*a* and 42*b* secured thereto. The wheels on the outer leg are spaced apart a greater distance than the wheels on the inner legs. The distance as shown is approximately a 2:1 ratio. However, this ratio will vary depending upon the degree of curvature through which the dolly must travel.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A dolly for use in a straight sided flat bottom conveyor pan which dolly comprises:

a frame having an outer leg and an inner leg;

a pair of leading inner and outer wheels secured to the inner and outer legs at a first distance;

a pair of trailing inner and outer wheels secured to the inner and outer legs at a second distance, the leading wheels lying along an axis which is coincident with a radius R, the trailing wheels lying along an axis which is coincident with a radius $R^1$, the radii R and $R^1$ diverging from one another;

the frame having a width which is substantially co-extensive with the first distance between the leading wheels and co-extensive with the second distance between the trailing wheels whereby the dolly can support a rack having a width which is substantially co-extensive with the wheels of the dolly; and wherein a first support bar is secured to the underside of the frame and is aligned with the radius R and the leading wheels are secured to the ends of said first support bar and a second support bar is secured to the underside of the frame and is aligned with the radius $R^1$ and the trailing wheels are secured to the ends of said second support bar.

2. The dolly of claim 1 wherein the frame is rectangular.

3. The dolly of claim 2 wherein the frame is square.

4. The dolly of claim 1 wherein a stabilizing bar is secured to the support bars and the stabilizing bar is characterized by connector holes to facilitate the joining of like dollies in series one to the other.

5. The dolly of claim 1 wherein the bottom surfaces of the wheels are flat and the wheels are angled with reference to horizontal.

6. The dolly of any of claims 1, 2, 3, 4 and 5 wherein the frame is 20"×20".

* * * * *